US005433269A

United States Patent [19]

Hendrickson

[11] Patent Number: 5,433,269

[45] **Date of Patent: * Jul. 18, 1995**

[54] RETRIEVABLE PACKER FOR HIGH TEMPERATURE, HIGH PRESSURE SERVICE

[75] Inventor: James D. Hendrickson, Carrollton, Tex.

[73] Assignee: Halliburton Company, Houston, Tex.

[ * ] Notice: The portion of the term of this patent subsequent to May 17, 2011 has been disclaimed.

[21] Appl. No.: 147,694

[22] Filed: Nov. 3, 1993

Related U.S. Application Data

[63] Continuation-in-part of Ser. No. 884,529, May 15, 1992, Pat. No. 5,311,938.

[51] Int. Cl.[6] ..... E21B 33/128

[52] U.S. Cl. ..... 166/134; 166/182; 166/196

[58] Field of Search ..... 166/134, 138, 182, 196, 166/202, 123

[56] References Cited

U.S. PATENT DOCUMENTS

| | | | |
|---|---|---|---|
| 1,246,957 | 11/1917 | Lindsay . | |
| 1,336,738 | 4/1920 | Fletcher . | |
| 3,374,840 | 3/1968 | Current | 166/134 |
| 3,631,926 | 1/1972 | Young | 166/134 |
| 4,224,987 | 9/1980 | Allen | 166/120 |
| 4,457,369 | 7/1984 | Henderson | 166/125 |
| 4,809,989 | 3/1989 | Kernal | 277/30 |
| 4,834,175 | 5/1989 | Ross et al. | 166/120 |
| 5,273,109 | 12/1993 | Arizmendi et al. | 166/123 |

*Primary Examiner*—Terry Lee Melius

*Attorney, Agent, or Firm*—Tracy W. Druce; J. Richard Konneker

[57] ABSTRACT

In a retrievable packer adapted for service under high temperature and pressure conditions, improved sealing is provided by a seal element prop surface which is radially offset with respect to the seal element support surface of the packer body mandrel. At least one seal element is supported on the elevated prop surface and is subjected to a radial squeeze in the set configuration, even though the lowermost seal element may be subject to longitudinal separation. The split level seal element support arrangement provides an annular pocket into which the seal elements can be retracted upon release and retrieval of the packer, thereby providing clearance for unobstructed retrieval. Upon release of the packer, a retainer collar is shifted away from a lower metal backup shoe, thereby providing an annular pocket into which the metal backup shoe is deflected, so that it does not obstruct the drift clearance as the packer is retrieved. Preloading of the seal element assembly is provided by a cover sleeve which releases, and longitudinally moves along the body mandrel, when a predetermined amount of longitudinal seal compression has been achieved. The cover sleeve carries, for longitudinal movement therewith, an upper metal backup shoe positioned to be engaged and deformed by the upper end of the seal element assembly.

25 Claims, 9 Drawing Sheets

SET

RELEASE

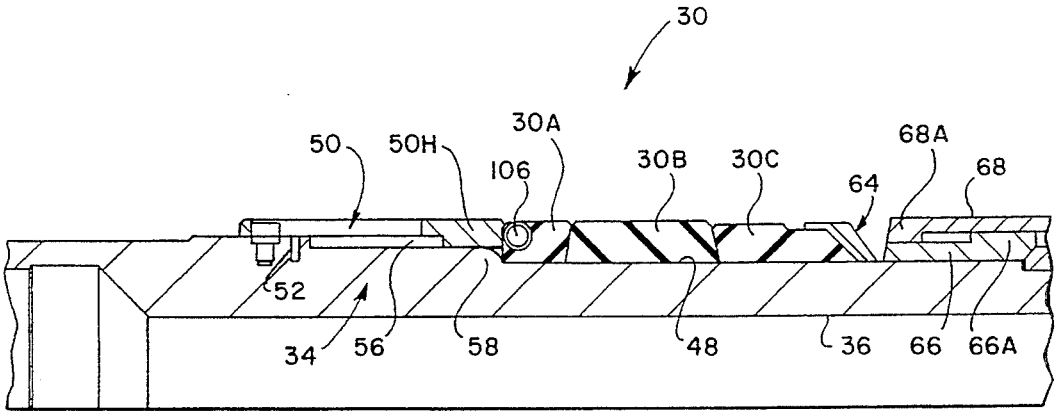
FIG. 7 RUN
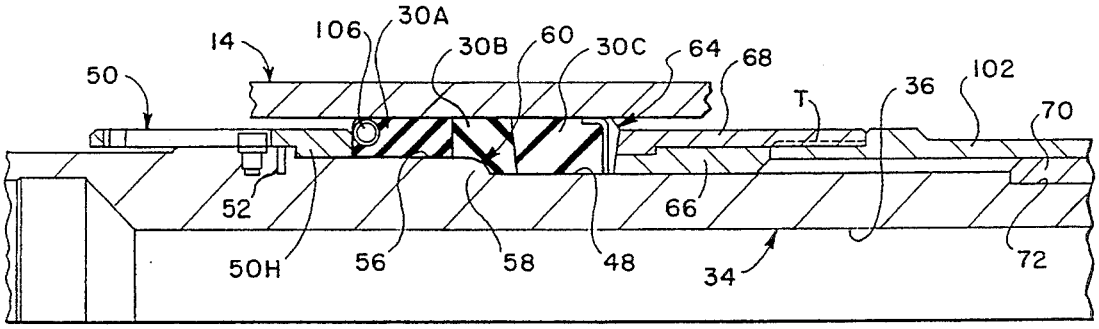
FIG. 8 SET
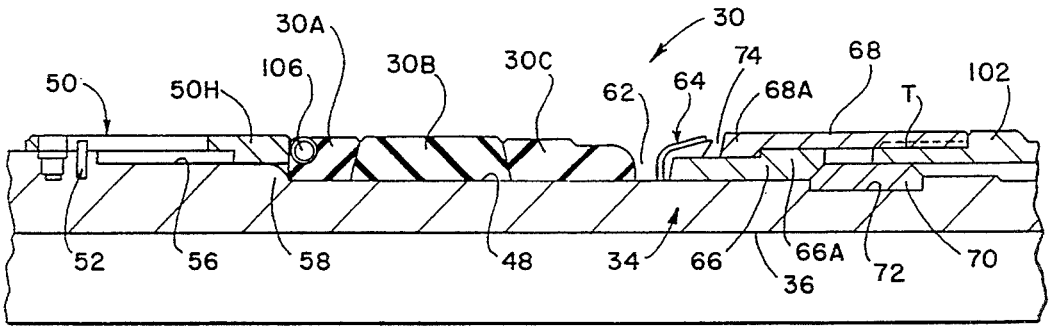
FIG. 9 RELEASE

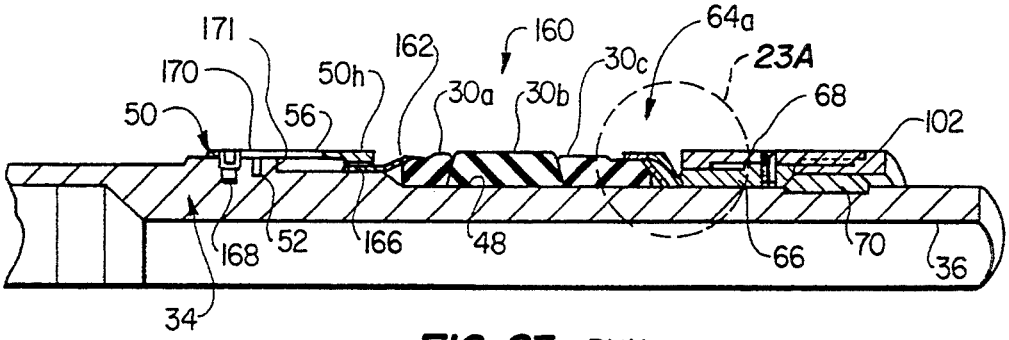
FIG. 23 RUN
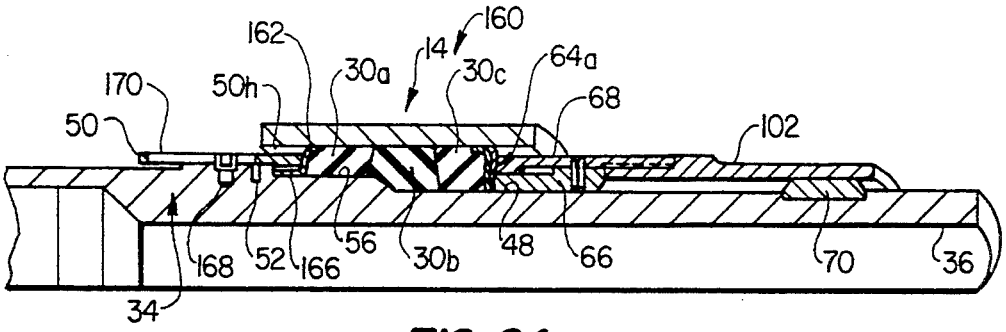
FIG. 24 SET
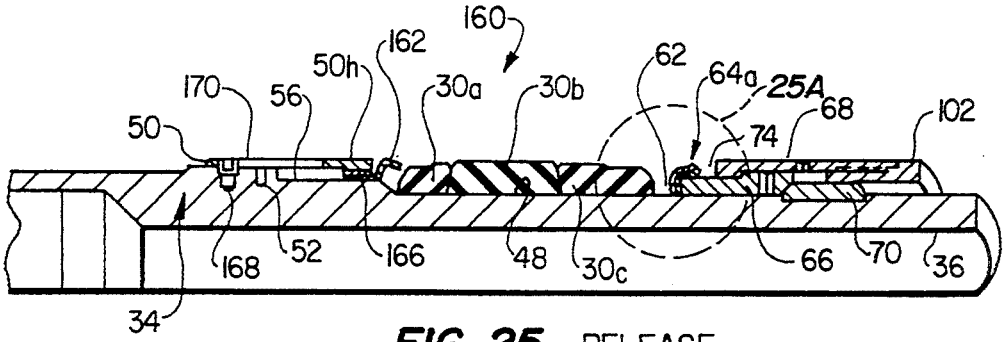
FIG. 25 RELEASE
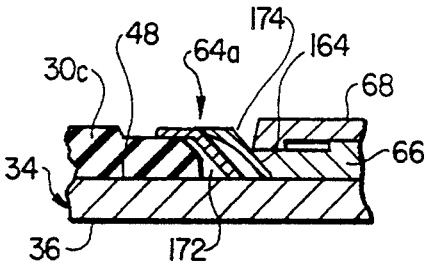
FIG. 23A
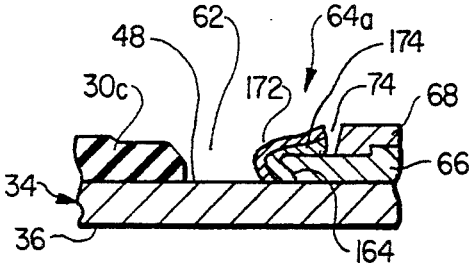
FIG. 25A

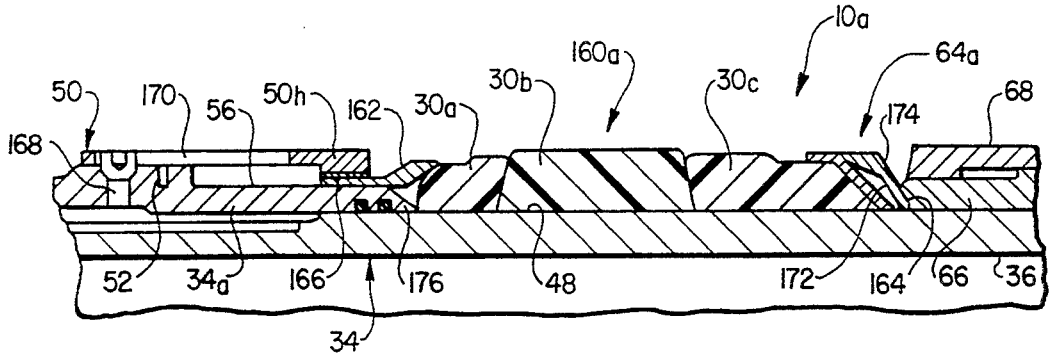
*FIG. 26* RUN
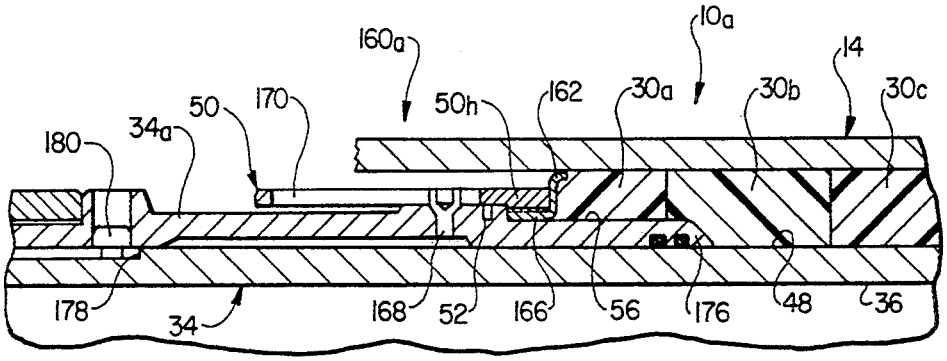
*FIG. 27* SET
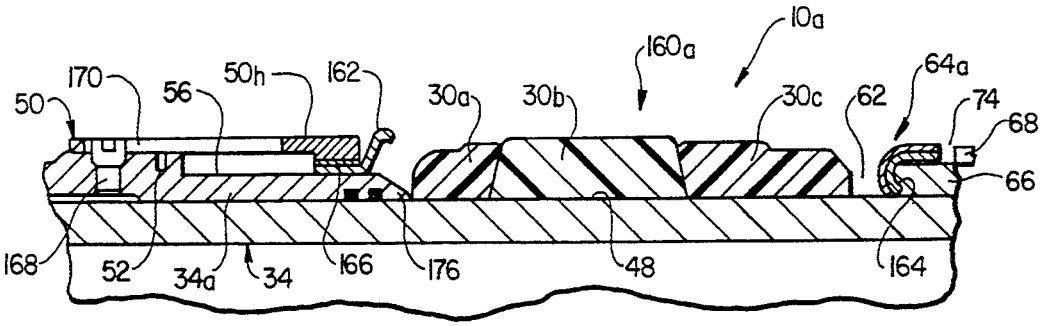
*FIG. 28* RELEASE

RETRIEVABLE PACKER FOR HIGH TEMPERATURE, HIGH PRESSURE SERVICE

CROSS REFERENCE TO RELATED APPLICATION

This application is a continuation-in-part of U.S. application Ser. No. 07/884,529 filed on May 15, 1992 and entitled "RETRIEVABLE PACKER FOR HIGH TEMPERATURE, HIGH PRESSURE SERVICE", U.S. Pat. No. 5,311,938.

FIELD OF THE INVENTION

This invention relates to tools and equipment for completing subterranean wells, and in particular to retrievable well packers for releasably sealing the annulus between a tubing string and the bore of the surrounding well casing.

BACKGROUND OF THE INVENTION

In the course of treating and preparing subterranean wells for production, a well packer is run into the well on a work string or a production tubing. The purpose of the packer is to support production tubing and other completion equipment such as a screen adjacent to a producing formation and to seal the annulus between the outside of the production tubing and the inside of the well casing to block movement of fluids through the annulus past the packer location. The packer is provided with anchor slips having opposed camming surfaces which cooperate with complementary opposed wedging surfaces, whereby the anchor slips are radially extendible into gripping engagement against the well casing bore in response to relative axial movement of the wedging surfaces. The packer also carries annular seal elements which are expandable radially into sealing engagement against the bore of the well casing in response to axial compression forces. Longitudinal movement of the packer components which set the anchor slips and the sealing elements may be produced either hydraulically or mechanically.

After the packer has been set and sealed against the well casing bore, it should maintain sealing engagement upon removal of the hydraulic or mechanical setting force. Moreover, it is essential that the packer remain locked in its set and sealed configuration while withstanding hydraulic pressures applied externally or internally from the formation and/or manipulation of the tubing string and service tools without unsetting the packer or interrupting the seal. This is made more difficult in deep wells in which the packer and its components are subjected to high downhole temperatures, for example, as high as 600 degrees F., and high downhole pressures, for example, 5,000 psi. Moreover, the packer should be able to withstand variation of externally applied hydraulic pressures at levels up to as much as 10,000 psi in both directions, and still be retrievable after exposure for long periods, for example, from 10 to 15 years or more. After such long periods of extended service under extreme pressure and temperature conditions, it is desirable that the packer be retrievable from the well by appropriate manipulation of the tubing string to cause the packer to be released and unsealed from the well bore, with the anchor slips and seal elements being retracted sufficiently to avoid seizure against well bore restrictions that are smaller than the retracted seal assembly, for example, at a makeup union, collar union, nipple or the like.

DESCRIPTION OF THE PRIOR ART

Currently, permanent packers are used for long-term placement in high temperature, high pressure wells. Conventional permanent packers are designed in such a way that they become permanently fixed to the casing wall and that helps in the sealing of the element package. However, permanent packers must be milled for removal. One of the major problems involved in removing a permanent packer is that its element package normally has large metal backup rings or shoes that bridge the gap between the packer and the casing and provide a support structure for the seal element to keep it from extruding out into the annulus. The problem with that arrangement is that the large metal backup shoes act like a set of slips and will not release from the casing wall.

Present retrievable high pressure packers use multiple C-ring backup shoes that are difficult to retract when attempting to retrieve the packer. A further limitation on the use of high pressure retrievable packers of conventional design, for example, single slip packers, is that if there is any slack in setting of the packer, or any subsequent movement of the packer, some of the compression force on the element package is relieved. This reduces the total compression force exerted on the seal elements between the mandrel and the casing, therefore permitting a leakage passage to develop across the seal package.

Conventional high pressure retrievable packers utilize backup shoes on the top and bottom seal elements. Consequently, it takes more force to set the seal element package in such a packer because of the drag produced by the metal backup shoes. That is, during set engagement, the slip carrier moves and the seal elements drag against the well casing bore until anchor slip bite against the casing bore is achieved. It will be appreciated that a substantially greater external setting force, either hydraulic or mechanical, will be required to overcome the drag imposed by the metal backup shoes on the top and bottom elements.

The metal backup shoes which prevent extrusion of the seal elements in permanent packers also interfere with retrievability. That is, during compression of the seal elements in a permanent packer, the seal elements are compressed longitudinally, with the compressed seal material-filling the annulus between the mandrel and the casing wall and the backup shoes preventing extrusion of the seal elements out of the established compression zone. In such permanent packers, the seal elements are removed by milling, since the seal elements and backup shoes cannot be fully retracted within the drift dimension. Consequently, the radially projecting seal elements drag against the casing bore, and the backup shoes act somewhat like anchor slips as they bite into the well casing.

It can readily be seen from the foregoing that it would be desirable to provide an improved high temperature, high pressure retrievable packer that eliminates, or at least substantially reduces the above-mentioned problems, limitations and disadvantages commonly associated with retrievable packers of the conventional construction generally described above. It is accordingly an object of the present invention to provide such a retrievable packer.

SUMMARY OF THE INVENTION

In carrying out principles of the present invention, in accordance with a preferred embodiment thereof, a specially designed high temperature, high pressure retrievable well packer is provided and is coaxially disposable in a well casing having an internal bore side wall. The retrievable packer includes a tubular body mandrel having upper and lower ends, an annular seal element support surface, and an annular seal element prop surface positioned above and radially outwardly offset from the seal element support surface. An annular seal element assembly is coaxially mounted on the seal element support surface for longitudinal movement therealong and has upper and lower ends.

A cover sleeve is coaxially mounted on the body mandrel for longitudinal movement relative thereto between a downwardly extended position in which the prop surface is covered by the sleeve, and an upwardly retracted position in which the sleeve uncovers the prop surface, the cover sleeve having a lower end facing the upper end of the seal element assembly. The cover sleeve is releasably retained in its extended position by frangible means, representatively in the form of shear pins interconnecting the cover sleeve and the body mandrel.

In conjunction with the seal element assembly annular upper and lower backup shoe structures are provided. The upper shoe structure coaxially circumscribes the body mandrel and is fixedly secured to the lower end of the cover sleeve for longitudinal movement with the cover sleeve relative to the body mandrel. The lower shoe structure coaxially circumscribes the body mandrel downwardly adjacent the lower end of the seal element assembly and has a radially inner annular edge portion.

An annular abutment structure is coaxially mounted on the body mandrel below the lower shoe structure and has an upper end with an annular recess formed in a radially inner portion thereof. Force transmitting means are operable to cause (1) the seal element assembly to be longitudinally compressed between the upper and lower shoe structures, (2) the seal element assembly to longitudinally drive the cover sleeve from its extended position to its retracted position, (3) an upper end portion of the seal element assembly to be driven onto the prop surface, (4) the seal element assembly to be radially expanded into set engagement with the internal bore side wall of the-well casing, (5) the upper and lower shoe structures to be deformed into radially bridging engagements with the internal bore side wall of the well casing, and (6) the annular edge portion of the lower shoe structure to enter and be radially retained within the annular recess in the upper end of the force transmitting structure.

The fixed connection of the upper shoe structure to the cover sleeve for movement therewith prevents the upper shoe structure from pulling free and lodging between the packer seal assembly and the casing, thereby jamming the packer in the casing and preventing its withdrawal therefrom. The provision in the upper end of the abutment structure of the annular recess that receives a radially inner portion of the lower shoe structure functions to prevent a radial pull-away of the lower shoe structure which could cause it to jam between the packer and the casing, thereby preventing withdrawal of the packer from the casing.

The seal element has an annular configuration and, according to one aspect of the present invention, has a radial thickness sized to cause the portion of the seal element assembly forced onto the prop surface to be radially squeezed between the prop surface and the internal bore side wall of the casing.

Movement limiting means are preferably provided for limiting the longitudinal movement of the cover sleeve relative to the body mandrel subsequent to a breakage of the frangible means permitting such longitudinal movement. The movement limiting means representatively include a longitudinal slot formed in the cover sleeve, and a stop member secured to the body mandrel and received in the cover sleeve slot.

According to another aspect of the present invention, the annular abutment structure is operable to create on an upper end portion thereof a radially outer annular pocket area into which a radially outer annular portion of the lower shoe structure may be downwardly deformed during withdrawal of the packer from the casing.

BRIEF DESCRIPTION OF THE DRAWINGS

FIG. 7 is a longitudinal view in quarter section of a well packer showing the relaxed position of seal elements in the run position;

FIG. 8 is a view similar to FIG. 7 showing the compressed, expanded position of the seal elements in the set position;

FIG. 9 is a view similar to FIG. 7 showing the seal elements in the relaxed, released position;

FIG. 23 is a longitudinal view in quarter section of an alternate hydraulically operable embodiment of the well packer showing the relaxed position of the seal elements in the run position of the well packer;

FIG. 23A is an enlargement of the circled area "23A" in FIG. 23;

FIG. 24 is a view similar to FIG. 23 showing the longitudinally compressed, radially expanded position of the seal elements with the well packer in its set position;

FIG. 25 is a view similar to FIG. 23 showing the seal elements in their relaxed position with the well packer in its released position;

FIG. 25A is an enlargement of the circled area "25A" in FIG. 25;

FIG. 26 is a longitudinal view in quarter section of an alternate mechanically operable embodiment of the well packer showing the relaxed position of the seal elements in the run position of the well packer;

FIG. 27 is a view similar to FIG. 26 showing the longitudinally compressed, radially expanded position of the seal elements with the well packer in its set position; and FIG. 28 is a view similar to FIG. 26 showing the seal elements in their relaxed position with the well packer in its released position.

DETAILED DESCRIPTION

Figure 1:
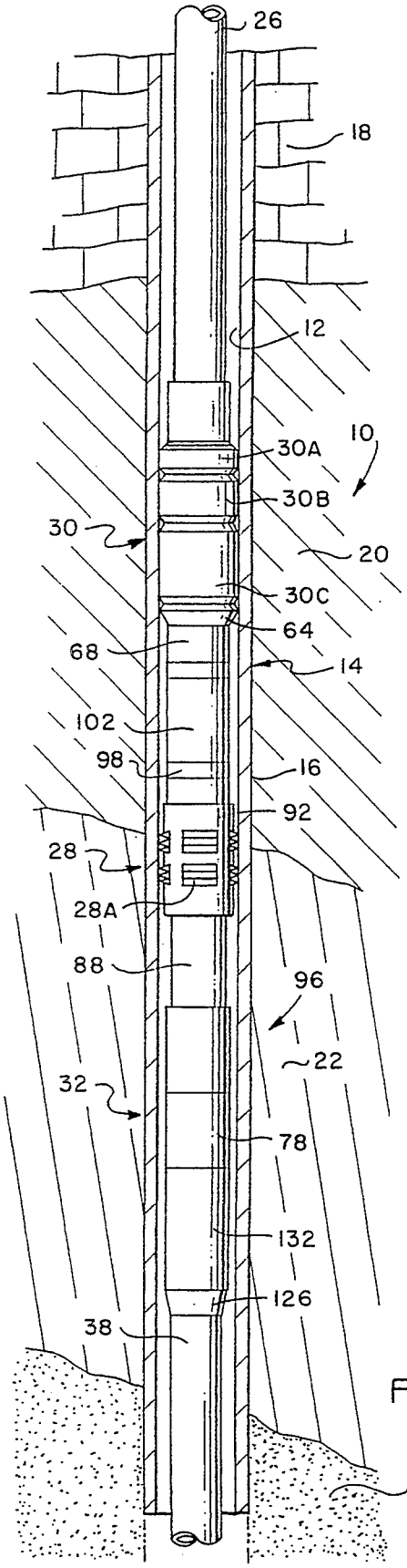
FIG. 1 is a longitudinal view in elevation and section of a retrievable well packer embodying the features of the present invention set in the casing of a well bore providing a releasable seal with the casing wall and a tubing string extending to the packer.

In the description which follows, like parts are marked throughout the specification and drawings with the same reference numerals, respectively. The drawings are not necessarily to scale and the proportions of certain parts have been exaggerated to better illustrate details and features of the invention. As used herein, the designation "S" refers to internal and external O-ring seals and the designation "T" refers to a threaded union.

Referring now to FIG. 1, a well packer 10 is shown in releasably set, sealed engagement against the bore 12 of a well casing 14. The tubular well casing 14 lines a well bore 16 which has been drilled through an oil and gas producing formation, intersecting multiple layers of overburden 18, 20 and 22, and then intersecting a hydrocarbon producing formation 24. The mandrel of the packer 10 is connected to a tubing string 26 leading to a wellhead for conducting produced fluids from the hydrocarbon bearing formation 24 to the surface. The lower end of the casing which intersects the producing formation is perforated to allow well fluids such as oil and gas to flow from the hydrocarbon bearing formation 24 through the casing 14 into the well bore 12.

The packer 10 is releasably set and locked against the casing 14 by an anchor slip assembly 28. A seal element assembly 30 mounted on the packer body mandrel is expanded against the well casing 14 for providing a fluid tight seal between the packer mandrel and the well casing so that formation pressure is held in the well bore below the seal assembly and formation fluids are forced into the bore of the packer to flow to the surface through the production tubing string 26.

The packer 10 is run into the well bore and set by either a mechanical running tool or by hydraulic means. The anchor slips of the anchor slip assembly 28 are first set against the well casing, followed by expansion of the seal element assembly. The packer includes force transmitting apparatus with a ratchet lock assembly which maintains the set condition after the mechanical setting force or hydraulic setting pressure is removed. The packer 10 is readily retrieved from the well bore with the assistance of a retrieving tool and by a straight upward pull which is conducted through the packer mandrel to a release assembly 32 which permits the upper slip to retract and the seal elements to relax, thus freeing the packer for retrieval to the surface.

Referring now to FIGS. 1-6, the anchor slip assembly 28, the seal element assembly 30 and release assembly 32 are mounted on a tubular body mandrel 34 having a cylindrical bore 36 defining a longitudinal production flow passage. The lower end of the packer body mandrel 34 is releasably coupled to a lower production tubing string 38 by the release assembly 32. The lower tubing string 38 is continued below the packer within the well casing for supporting a sand screen, polished nipple, tail screen and sump packer, for example. The central passage of the packer bore 36 as well as the polished bore, bottom sub bore, polished nipple, sand screen and the like are concentric with and form a continuation of the tubular bore of the upper tubing string 26.

In the preferred embodiment described herein, the packer 10 is set by a hydraulic actuator assembly 40 (FIG. 4) which includes force transmitting assembly 42 for applying setting forces to the anchor slip assembly 28 and seal element assembly 30. The hydraulic actuator assembly 40 is concentrically mounted about and onto the packer mandrel body 34 between the release assembly 32 and the anchor slip assembly 28. The setting forces are coupled to the anchor slip assembly by a lower force transmitting assembly 44 and an upper force transmitting assembly 46.

Figure 2:
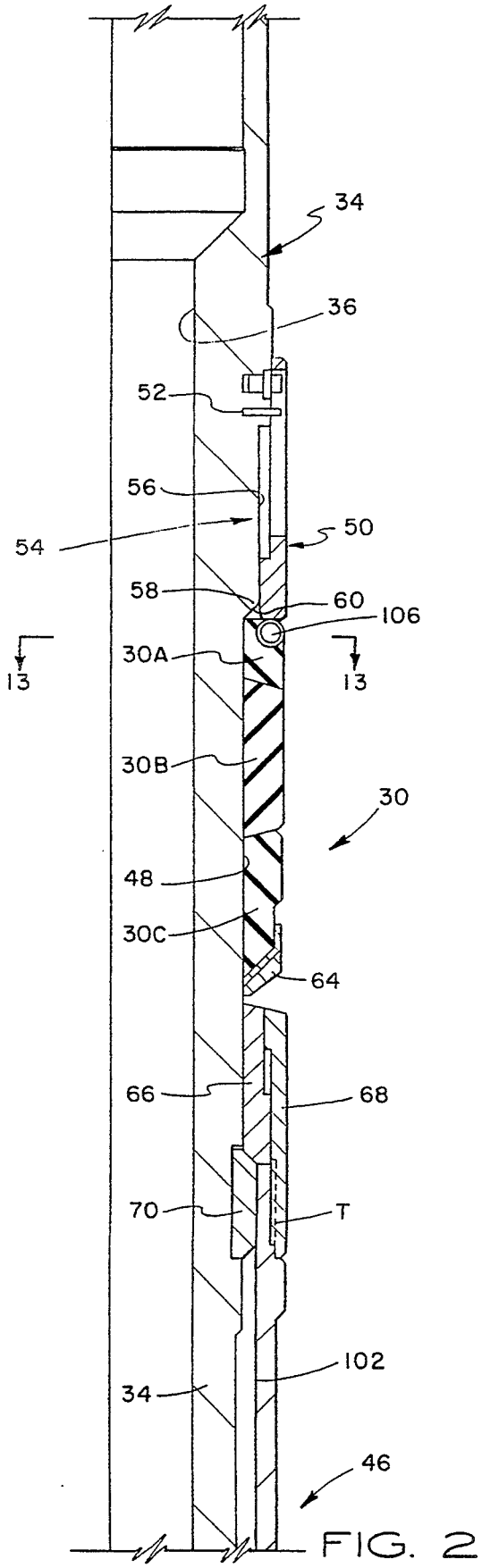
FIGS. 2 through 6, inclusive and taken together, form a longitudinal view in section of the retrievable well packer and seal assembly of the invention showing the seal assembly relaxed and the packer slips retracted as the packer is run into a well bore.

Referring now to FIG. 2, the seal element assembly 30 is mounted directly onto an external support surface 48 of the packer mandrel body 34. The seal element assembly 30 includes an upper outside packing end element 30A, a center packing element 30B and a lower outside packing end element 30C. According to an important feature of the present invention, the upper end seal element 30A is releasably fixed against axial upward movement by engagement against a cover sleeve 50. The cover sleeve 50 is movably mounted on the body mandrel 34 for longitudinal movement from an extended position, as shown in FIG. 2, in which the cover sleeve engages the upper outside seal element 30A, to a retracted position (FIG. 8) which permits the seal element assembly to travel upwardly along the external surface of the packer mandrel body 34. The cover sleeve 50 is releasably secured by one or more shear pins 52 to the body mandrel 34 at the extended position at which it engages the upper outside seal element 30A. In this arrangement, the seal element assembly undergoes longitudinal compression by the upper force transmitting assembly 46 until a predetermined amount of compression and expansion have been achieved.

According to another important feature of the invention, improved sealing engagement is provided by prop apparatus 54 which is mounted on the packer body mandrel 34. In the preferred embodiment, the prop apparatus is a radially stepped shoulder member 54 which is integrally formed with the body mandrel, with the prop surface 56 being radially offset with respect to the seal element support surface 48. In this arrangement, the prop apparatus 54 forms a part of the tubular body mandrel 34. The seal element prop surface 56 is preferably substantially cylindrical, and the seal element support surface is also preferably substantially cylindrical. As can be seen in FIG. 2, the seal element prop surface 56 is substantially concentric with the seal element support surface 48.

As the shear pins separate in response to the application of setting force through the force transmitting assembly 46, the radially offset prop surface 56 is injected under the upper outside seal element 30A and also under the central seal element 30B, substantially as shown in FIG. 8. Preloading of the seal element assembly 30 provided by the cover sleeve 50 supplies the initial radial movement of the seal elements which make it easier to get the elements up onto the prop surface 56 without damaging the elements. Radial deflection and transition movement of the seal elements from the lower O.D. of the packer mandrel surface 48 to the upper O.D. of the prop surface 56 is assisted by an annular ramp member 58 which is disposed intermediate the mandrel 34 and the prop apparatus 54.

The ramp member 58 has an external surface 60 which slopes transversely with respect to the seal element support surface 48 and the seal element prop surface 56. Preferably, the slope angle as measured from the seal element support surface 48 to the external surface 60 of the ramp member 58 is in the range of from about 135 degrees to about 165 degrees. The purpose of the ramp surface is to provide a gradual transition to prevent damage to the upper seal element 30A as it is deflected onto the radially offset prop surface 56.

Figure 22:
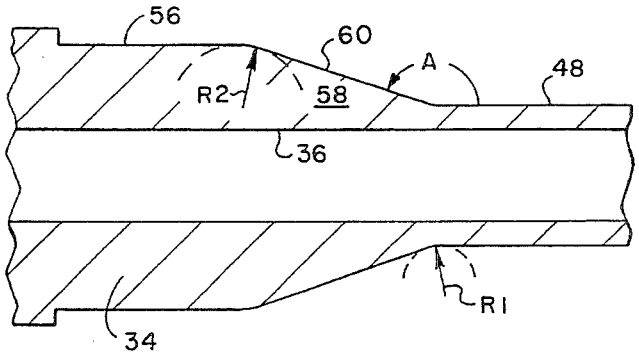
FIG. 22 is a sectional view, partially broken away, which illustrates the radially stepped seal element support surfaces of the present invention.

Referring to FIG. 22, a transitional radius R1 is provided between the packer mandrel surface 48 and the sloping ramp surface 60, and a second radius R2 is provided between the ramp surface 60 and the radially offset prop surface 56. The two radius surfaces R1, R2 complement each other so that there is a smooth movement of the upper end element seal 30A from the packer mandrel surface 48 to the radially offset prop surface 56 without damage to the seal element material. For a slope angle A of 135 degrees, a relatively small radius of transition R1 of 0.06 inch radius is provided, and the second, relatively large radius is approximately 0.5 inch radius. According to this arrangement, a gently sloping ramp surface 60 provides an easy transition for the preloaded upper end seal element 30A to be deflected onto the radially offset prop surface 56. As the slope angle is increased, it becomes more important to radius the corners of the transition, and the specific radius values are determined based primarily on the size of the packer.

Referring now to FIGS. 7, 8 and 9, the longitudinal dimensions of the sealing elements 30A, 30B and 30C, and the length of the prop surface 56 are so selected that the upper outside end seal element 30A and the central seal element 30B are compressed against the seal element prop surface 56 and the lower outside seal element 30C is compressed against the body mandrel support surface 48 when the seal element assembly is expanded into sealing engagement against a well casing, as shown in FIG. 8.

In this split level seal support arrangement, at least one of the seal elements, the upper end seal element 30A, is supported on the elevated prop surface 56 and is subjected to a radial squeeze compression force in the set configuration, even though the lowermost outside seal element 30C may be subject to longitudinal separation as a result of internal slack during setting, or as a result of externally applied pressure fluctuations.

Another advantage of the split level seal element support arrangement is that the radially reduced support surface 48 of the packer mandrel provides an annular pocket 62 (FIG. 9) into which the seal elements are retracted upon release and retrieval of the packer. That is, upon release, the seal elements 30A, 30B are pushes off of the prop surface 56 and slide onto the lower mandrel seal support surface 48 within the annular pocket 62. Thus the seal elements are permitted to expand longitudinally through the annular pocket 62, and away from the drift clearance thereby permitting unobstructed retrieval.

As shown in FIG. 2 and FIG. 7, the upper outside seal element 30A has a substantially shorter longitudinal dimension than the central seal element 30B and the lower outside seal element 30C. The longitudinal dimension of the prop surface 56 is selected so that both the upper outside seal element 30A is fully supported and the central seal element 30B is at least partially supported on the radially offset prop surface 56 in the set, expanded position, as shown in FIG. 8. Even though the lower outside seal element 30C and the central seal element 30B may be subjected to longitudinal excursions as a result of pressure fluctuations, the sealing engagement of the upper outside seal element 30A is maintained at all times.

The lower outside seal element is reinforced with a metal backup shoe 64. The metal backup shoe 64 provides a radial bridge between the body mandrel 34 and the well casing 14 when the seal element assembly is expanded into engagement against the internal bore sidewall of the well casing, as shown in FIG. 8. The purpose of the metal backup shoe 64 is to bridge the gap between the packer mandrel and the casing and provide a support structure for the lower outside seal element 30C to prevent it from extruding into the annulus between the packer mandrel and the well casing.

The dimensions of the seal elements and the prop surface O.D. are selected to provide a minimum of 5 percent reduction in radially compressed thickness to a maximum of 30 percent reduction in radially compressed thickness as compared with the lower outside seal element 30C when compressed in the set position, for example as shown in FIG. 8.

The backup shoe 64 is preferably constructed in the form of annular metal discs, with the inside disc being made of brass and the outer metal disc being made of Type 1018 mild steel. Both metal discs are malleable and ductile, which is necessary for a tight conforming fit about the lower edge of the outside end seal element 30C. Additionally, the ductile feature is desired to permit the backup shoe to deflect and fold over as shown in FIG. 9 in the released position.

The force transmitting apparatus 46 which applies the setting force to the seal element package includes an a lower element retainer ring 66 mounted for longitudinal sliding movement along the seal element support surface 48 of the packer mandrel 34. An element retainer collar 68 is movably mounted on the external surface of the retainer ring 66 for longitudinal shifting movement from a retracted position (FIG. 7) in which the element retainer collar 68 and retainer ring 66 are engageable against the backup shoe 64, to an extended position longitudinally spaced from the outer backup shoe (FIG. 9) in the released position.

The retainer ring 66 and element retainer collar 68 have mutually engageable shoulder portions 66A, 68A, respectively, for limiting extension of the element retainer collar along the external surface of the retainer ring. A split ring 70 is received within an annular slot 72 which intersects the external surface 48 of the packer mandrel 34. The split ring 70 limits retraction movement of the lower element retainer ring 66, thus indirectly limiting retraction movement of the element retainer collar 68, as shown in FIG. 9.

According to this arrangement, during a release operation, the shoulder 66A of the retainer ring 66 engages the split ring 70 and prevents further retraction movement. The element retainer collar 68 continues moving until its stop shoulder 68A engages the stop shoulder 66A. This opens an annular pocket 74 into which the metal backup shoe 64 is folded (FIG. 9) as the packer is retrieved. Upon release of the packer, the retainer collar 68 is shifted away from the metal backup shoe, thus opening the annular pocket 74. The metal backup shoe 64 is then deflected out of the annulus between the packer and the well casing, and into the receiver pocket 74 so that it will not obstruct the drift clearance as the packer 10 is retrieved.

Figure 3:
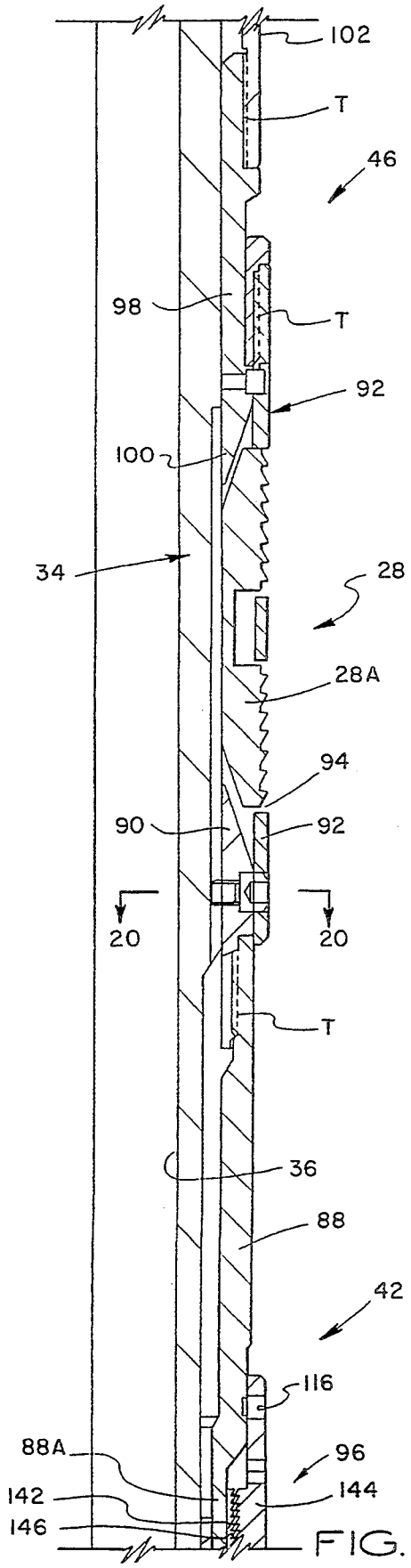
Figure 4:
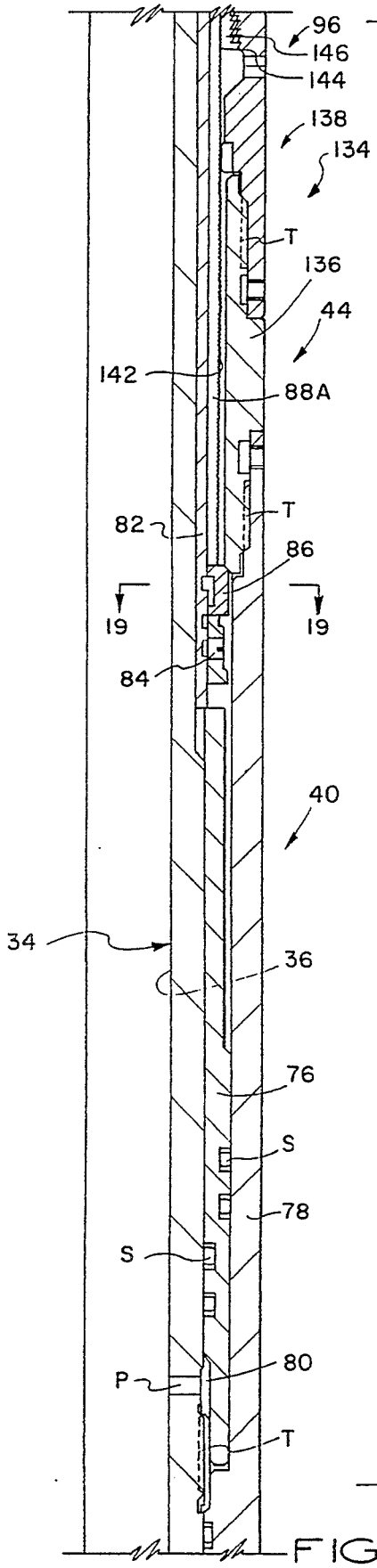

Referring again to FIGS. 2–6, the hydraulic actuator assembly 40 is coupled to the force transmitting assembly 42 for radially extending the anchor slip assembly 28 and seal element assembly 30 into set engagement against the well bore. Referring to FIG. 4, the hydraulic actuator includes a tubular piston 76 which carries annular seals S for sealing engagement against the external surface of the packer mandrel 34. The piston 76 is also slidably sealed against the inside bore of a tubular release sub 78. Hydraulic pressure is applied through an inlet port P which pressurizes an annular chamber 80. As the chamber is pressurized, the piston 76 is driven into engagement with a slip tube 82 which is slidably mounted about the packer body mandrel 34. The slip tube 82 is releasably coupled to the release sub 78 by a shear screw 84 and lock ring 86. A pair of annular slots are formed in the surface of the slip tube 82, and as the shear screw 84 separates, shoulder portions of the lock ring 86 are received within the annular slots, thereby transmitting the setting force to the lower tubular wedge 88.

Referring again to FIG. 3, the lower tubular wedge is connected to a lower spreader cone 90 which is positioned between the packer mandrel external surface and the internal bore of the slip carrier 92. The lower spreader cone 90 is formed in two complementary half sections 90A, 90B.

The slip anchor assembly 28 includes a plurality of slip anchors 28A which are mounted for radial movement through windows 94 formed in the tubular slip carrier 92. While the number of anchor slips 28A may be varied, the tubular slip carrier 92 is provided within an appropriate corresponding number of windows 94, with four anchor slips being preferred. Each of the anchor slips includes upper and lower gripping surfaces positioned to extend radially through the slip carrier windows with the wall of the slip carrier between the paired windows confining a leaf spring which resides in a recess of the anchor slip assembly. The leaf spring biases the anchor slips radially inwardly relative to the wall of the slip carrier 92, thereby maintaining the gripping surfaces retracted in the absence of forces displacing the anchor slips radially outwardly. Each of the gripping surfaces has horizontally oriented gripping edges which provide gripping contact in each direction of longitudinal movement of the packer 10. The gripping surfaces including the horizontal gripping edges, are radially curved to conform with the cylindrical internal surface of the well casing bore against which the slip anchor members are engaged in the set position.

The lower spreader cone 90 is positioned between the external packer mandrel surface and the lower bore of the slip carrier and features an upwardly facing frustoconical wedging surface which is generally complementary to the downwardly facing cam surface on the slip member 28A. The lower cone is connected to the tubular wedge 88 by a threaded union T. Retraction movement of the lower tubular wedge 88 is limited by the ratchet coupling 96. In the run in position as illustrated in FIG. 3, the tubular bottom wedge 88 and spreader cone 90 are fully retracted, and are blocked against further downward movement relative to the slip carrier by the stop ring assembly 96.

The slip carrier is releasably coupled to the spreader cone 90 by anti-preset shear screws. According to this arrangement, as the piston 76 is extended in response to pressurization through the port P, the lower wedge 88 and slip carrier, together with the anchor slip assembly is extended upwardly toward the seal element assembly 30. The element retainer collar 68 is coupled to the upper wedge 98 and upper spreader cone 100 by a tubular setting cylinder 102.

As the element retainer collar 68 is driven into engagement with the backup shoe 64, the resilient seal elements 30A, 30B and 30C undergo longitudinal compression until a predetermined amount of radial expansion has been produced. Longitudinal movement of the seal element assembly 30 is opposed by the cover sleeve 50 until the shear pins 52 separate. When a predetermined amount of compression and expansion have been achieved, the shear pins separate and the upper outside seal element is deflected along the sloping surface 60 of the transition member 58 and rides upon the radially offset prop surface 56. The seal element assembly 30 undergoes further compression and expansion as the head 50H of the cover sleeve 50 engages a radially offset shoulder 104 on the packer mandrel.

As the seal elements continue to expand into engagement with the well casing 14, the top portion of the anchor slips will ride up on the upper spreader cone and drag against the well casing, thereby causing the anti-preset pins on the slip housing 92 to separate. At that point, the lower spreader cone 90 is driven into engagement with the anchor slips. The anchor slips are then driven radially into gripping engagement with the well casing. Continued pressuring cinches the elements tighter and the set is retained by the segmented C-ring 146.

Figure 10:
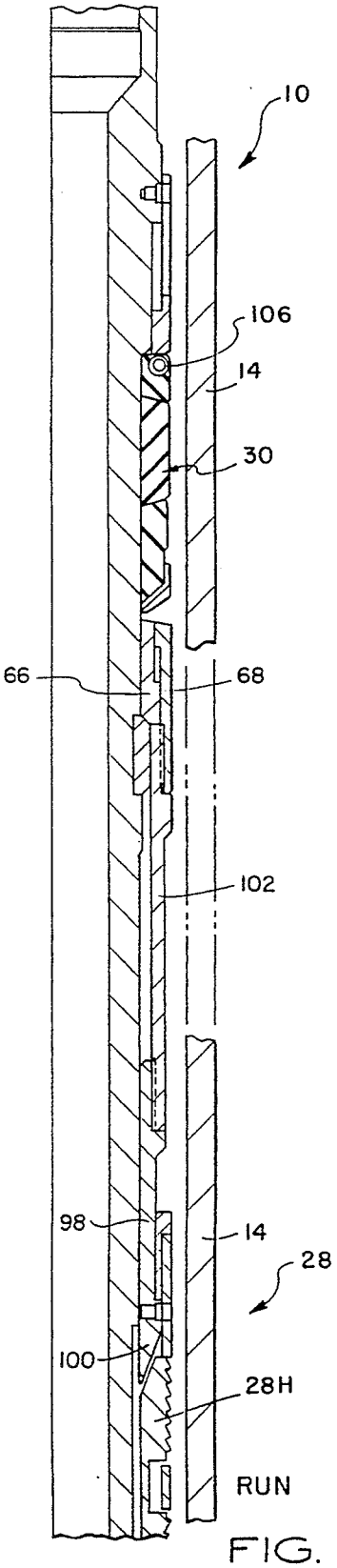
FIG. 10 is a longitudinal view in quarter section of a well packer constructed according to the present invention showing the relationship of the seal elements, force transmitting apparatus and anchor slips in the run position.
Figure 11:
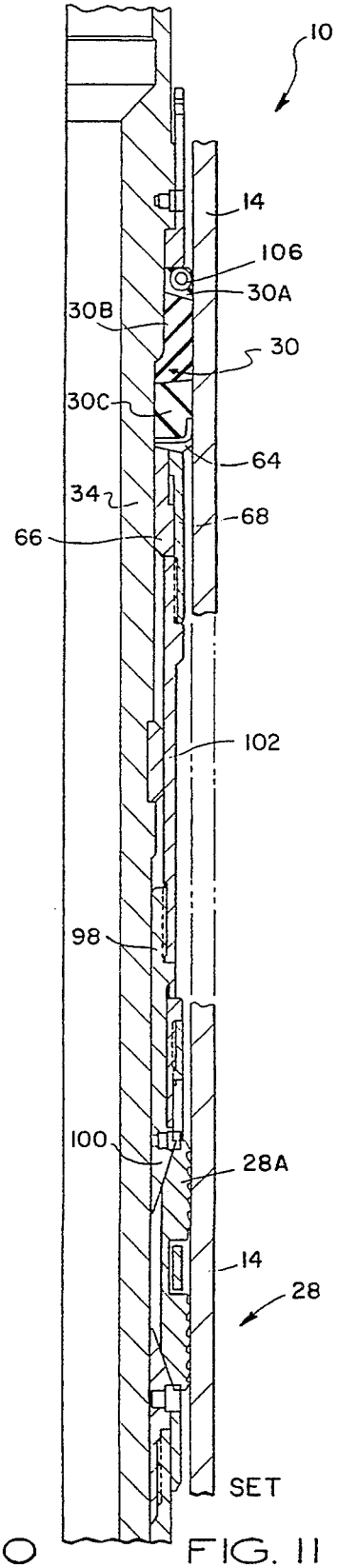
FIG. 11 is a longitudinal view in quarter section, similar to FIG. 10, showing the relative position of the seal elements, force transmitting apparatus and anchor slips in the set position.
Figure 12:
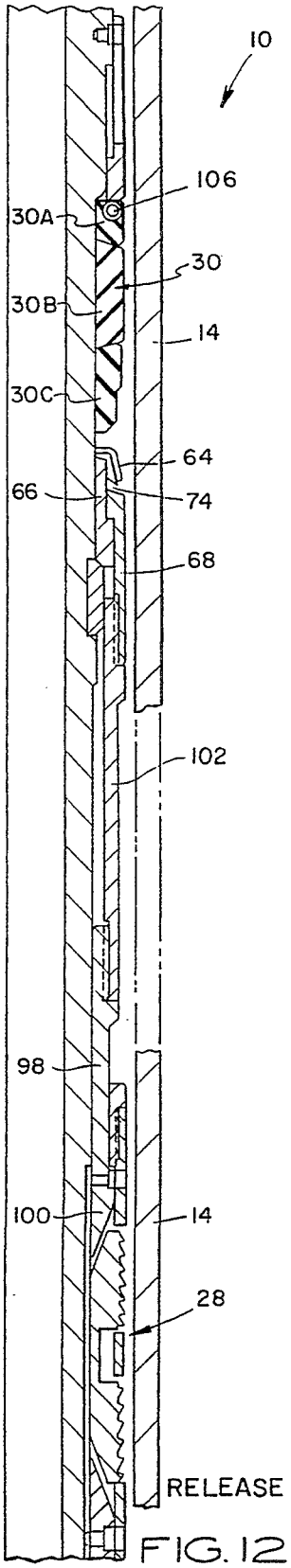
FIG. 12 is a longitudinal view in quarter section of a well packer showing the relative positions of the seal elements, force transmitting apparatus and slip elements in the released position.

The relative positions of the anchor slips and seal elements in the run, set and release positions are indicated in FIGS. 10, 11 and 12, respectively. The radially offset prop surface 56 is protected, and the seal elements 30 are shielded from engagement against obstructing surfaces by the cover sleeve 50 in the run position. The cover sleeve thus protects the seal element package when running into the well bore as the tubing string 26 is manipulated up and down, which is normally carried out while making up and breaking tubing string connections. The cover sleeve 50 also protects the element package, as shown in FIG. 12, when the packer has been released and is being retrieved from the well.

As shown in FIG. 11, the backup shoe 64 bridges the annulus between the packer mandrel 34 and the well casing 14. The primary purpose of the backup shoe 64 is to prevent extrusion of the lower outer seal element 30C into the annulus. The backup shoe 64 is deflected and retracted into the receiver pocket 74 as shown in FIG. 12 as the packer is retrieved. Because of the tendency of the backup shoe to act as an anchor slip, a garter spring assembly 106 is embedded in the upper outside seal element 30A to prevent extrusion into the annulus. The annular garter spring assembly 106 helps to center the seal element assembly 30 for uniform compression and expansion, thereby avoiding the formation of uneven extrusion gaps.

Figure 13:
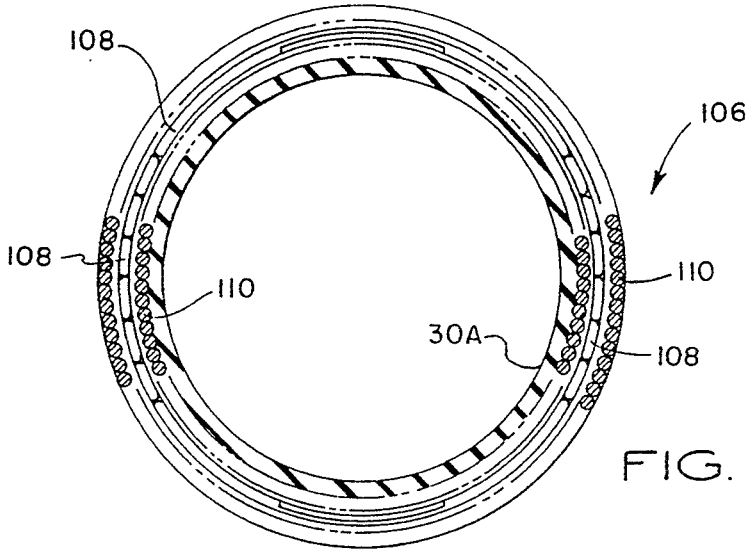
FIG. 13 is a cross section view of the improved seal element of the present invention, taken along the line 13—13 of FIG. 2, showing a single coil of reinforcing wire in the outside upper element, with reinforcement means enclosed within the coil.
Figure 14:
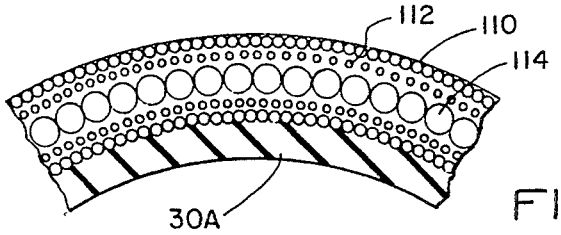
FIG. 14 is a sectional view similar to FIG. 13, and partially broken away, showing spherical reinforcement balls enclosed within the core of a dual reinforcement spring.
Figure 15:
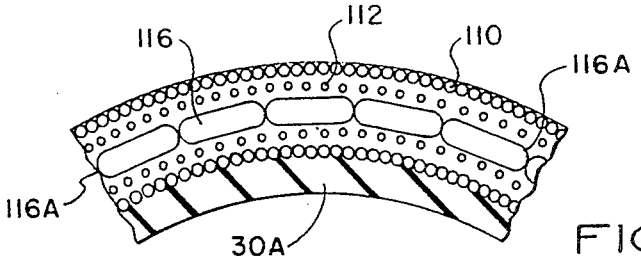
FIG. 15 is a view similar to FIG. 14 in which the deformation resistant reinforcing material is elongated pellets having radiused end portions.
Figure 16:
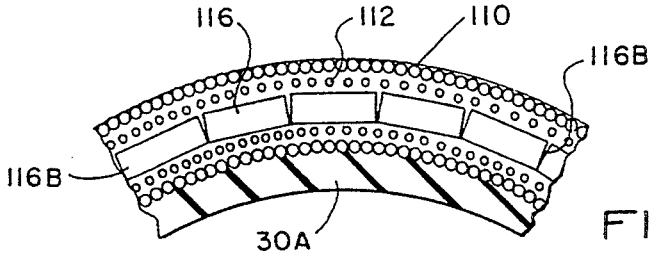
FIG. 16 is a view similar to FIG. 15 in which the elongated pellets have truncated end portions.

To provide reliable service at high differential pressure levels, for example, at 10,000 psi, it was necessary to provide a reinforced garter spring assembly 106 as shown in FIG. 13, and in the alternative embodiments as shown in FIGS. 14, 15 and 16. The failure mode of a non-reinforced end seal element is extrusion of the element past the containment means provided by the packer body. Adding a conventional garter spring, reinforces the seal element and prevents extrusion until the garter spring collapses and moves into the gap. The seal element is then free to extrude into the gap behind the failed portion of the garter spring.

It has been determined that a substantially improved garter spring assembly 106 can be achieved by enclosing a deformation resistant reinforcing material 108 within the garter spring. Referring to FIG. 13, the garter spring is formed by a single metal wire which is wound in a helical coil 110 which is embedded within the seal element 30A near the outside corner. That is, the deformation resistant reinforcing material 108 is completely enclosed within the helical turns of the garter spring coil 110.

According to one effective arrangement, the deformation resistant reinforcing material is enclosed within a second helical wound coil 112, which is enclosed within the outer garter spring coil 110, as shown in FIG. 14. Adding one or more concentric garter springs to the inside of the primary garter spring 110 reinforces the assembly and increases the pressure at which the packer element fails. However, more than two concentric coils are difficult to deploy. The unsupported inside diameter of the smaller garter spring 112 allows the garter spring combination to collapse and failure will occur, but at a proportionally higher pressure.

Further reinforcement is provided, as shown in FIG. 14, by spherical balls 114. According to one alternative embodiment, the deformation resistant reinforcing material is in the form of elongated pellets 116, as shown in FIG. 15. In that embodiment, the pellets 116 preferably have radiused end portions 116A. Yet another reinforcement embodiment is shown in FIG. 16, in which the elongated pellets 116 have truncated end portions 116B. The length of the pellets 116 is preferably in the range of from about 2 to about 3 times the cross sectional diameter of the pellets. Preferably, the cross sectional diameter of the pellets 116 and the balls 114 is slightly less than the inside diameter of the innermost garter spring 112.

The reinforcing material 108, whether it be in the form of the spherical balls 114 or the pellets 116, is preferably constructed of a deformation resistant material such as poly-ether ketone polymer, ceramic or a metal such as tungsten carbide.

Figure 5:
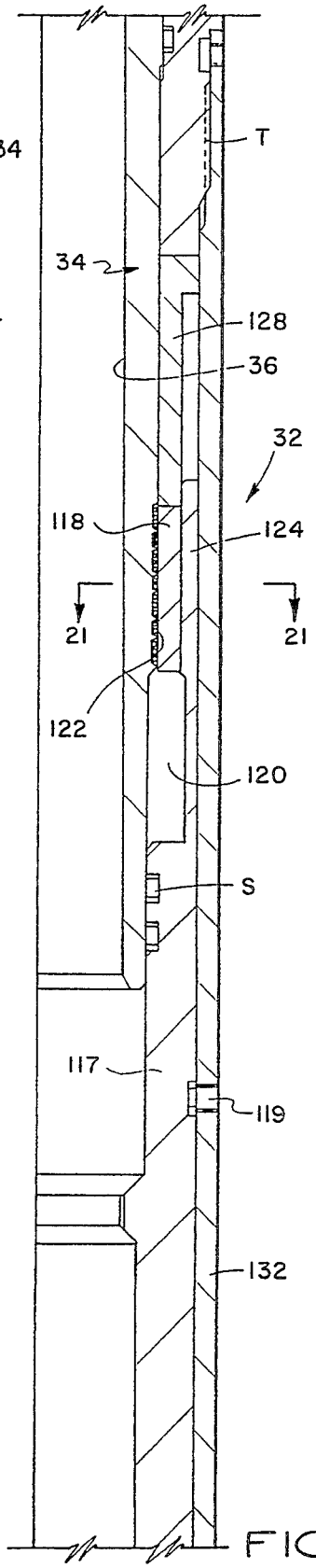
Figure 6:
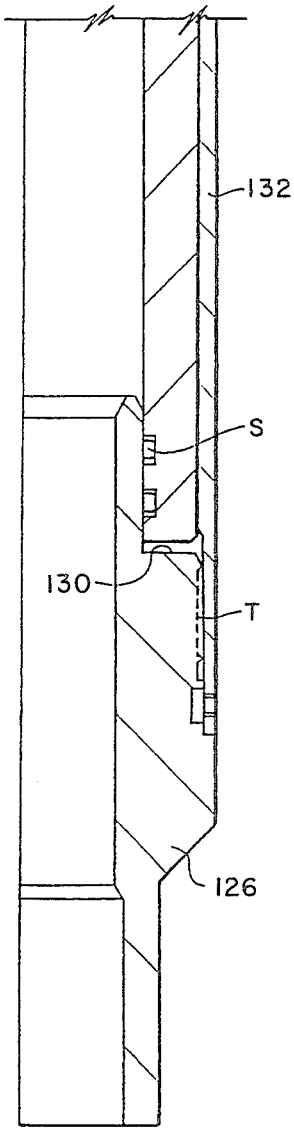

Referring to FIGS. 4, 5 and 6, the seal assembly 30 is removed with the tubing string prior to releasing the packer. A retrieving tool is attached to the work string and run to depth. The retrieving tool is latched into the latch profile located on the upper end of the packer 10. Upward pull on the retrieving tool causes lugs on the retrieving tool to engage a shifting sleeve 117 in the packer. Further upward pull shears the shear screws 119 on the shifting sleeve 117 allowing the release sleeve to move up aligning the recess 120 in the shifting sleeve 117 with the lock ring 118. The lock ring 118 is then free to disengage the mandrel 34. Continued upward pull shears screws 119 in the retrieving tool allowing the dogs to retract. Continued upward pull is transferred to the packer through the packer mandrel 34. The upper split ring 70 shoulders on the retainer ring 66. Its shoulder 66A shoulders on the retainer shoulder 68A, thereby opening the pocket 74 for the shoe 64 to retract. Continued upward pull draws the upper wedge 98 out from under the top portion of the slip 28H. The upper wedge picks up the slip carrier 92. The slip carrier 92 then pulls the slip from the lower wedge 90.

Pressure loading is applied to the tubular column presented by the lower tubular wedge 88 when pressuring from below. To prevent buckling collapse of the lower tubular wedge 88, it is desirable to provide radial support along its length. This is accomplished by a split support assembly 134 consisting of a split support ring 136, which is split into three segments, and an internal slip assembly 138. The lower tubular wedge 88 has a tubular, reduced diameter extension 88A which rides on a tubular 140, which is concentrically mounted on the packer mandrel 34. The column loading is relieved by the support assembly 34, with the load forces being conducted through the split ring assembly 136 through the release sub 78, through a threaded union T to the cylindrical housing 132 to the bottom connector sub 126. The lower tubular wedge extension 88A has helical threads 142 which bear against non-helical threads 144 carried by a C-ring 146. The C-ring 146 has ratchet threads which mate with ratchet threads formed on the inside bore of the internal slip assembly 138.

Figure 17:
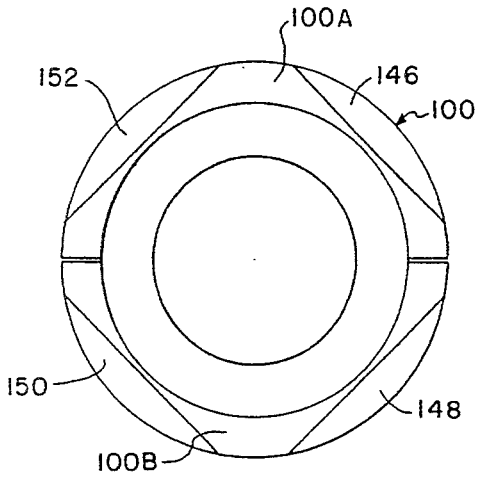
FIG. 17 is an elevational view of the top wedge removed from the packer mandrel.
Figure 18:
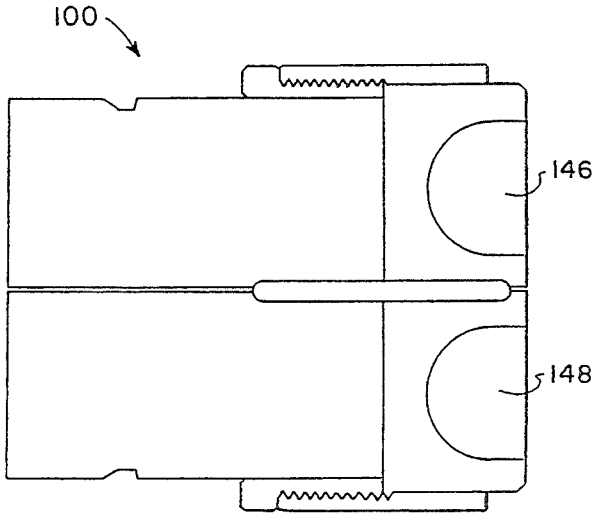
FIG. 18 is a top plan view of the top wedge removed from the packer mandrel.
Figure 19:
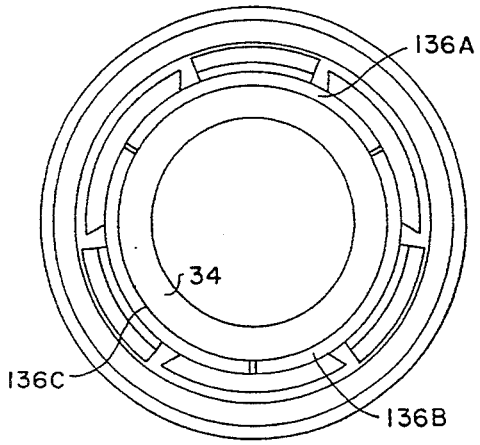
FIG. 19 is a sectional view of a segmented lock ring assembly taken along the lines 19—19 of FIG. 4.
Figure 20:
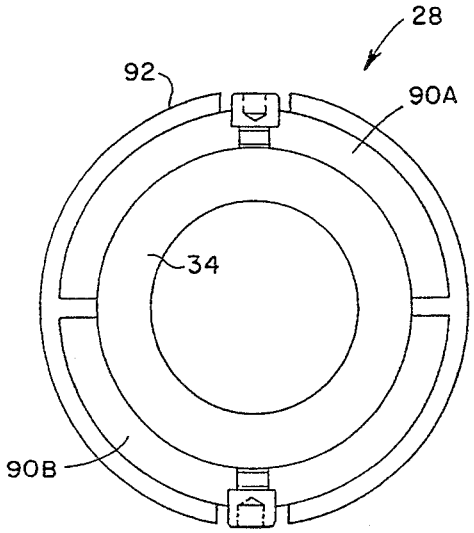
FIG. 20 is a sectional view of the slip carrier and lower wedge assembly taken along the line 20—20 of FIG. 3.
Figure 21:
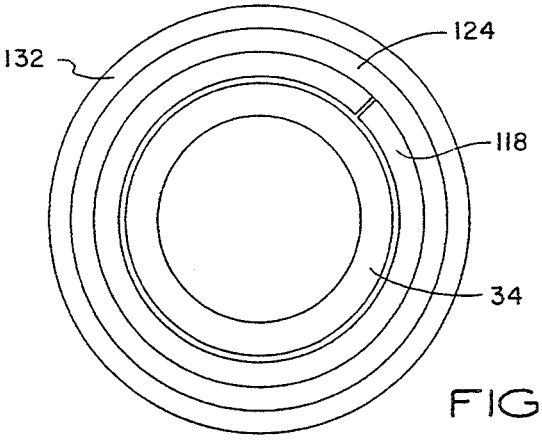
FIG. 21 is a sectional view of a releasable lock ring assembly taken along the line 21—21 of FIG. 5.

The load carrying capability of the anchor slips 28A is increased by increasing the cross sectional area of engagement between the slips and the upper spreader cone 100. Referring to FIG. 17 and FIG. 18, this is carried out by flat surfaces 146, 148, 150 and 152 which are machined externally on the spreader cone. That is, the load forces are transmitted to the slips across the flat surfaces and onto the sloping face of the anchor slips rather than on the conical diameter of the slip and cone. If contact was on the conical diameter of the slip and cone as found in conventional packers, the load forces would be transmitted by contact of the slips against the cone. Full force transmitting contact is provided by such conventional packers only at one diameter. However, by transmitting the forces through the flats on the surface of the cone and mating flats on the slips, the contact area is substantially increased. Moreover, in addition to providing increased load capability, the flats also improve the centralizing capability.

An alternate embodiment 160 of the previously described seal assembly 30 is illustrated in FIGS. 23–25A, with FIG. 23 illustrating the seal assembly 160 with the well packer in its run-in position; FIG. 24 illustrating the seal assembly 160 with the well packer in its set position; and FIG. 25 illustrating the seal assembly 160 with the well packer in its release position. Representatively, the packer 10 in which the seal assembly 160 is incorporated is a hydraulically operable packer.

As may be seen by comparing FIGS. 23–25A to FIGS. 7–9, four primary modifications are made to the seal assembly 160 compared to the previously described seal assembly. First, the garter spring assembly 106 is deleted from the upper end seal element 30A. Second, an annular upper metal backup shoe 162 is added to the seal assembly 160. Third, the well packer is provided with a modified bottom backup shoe structure **64*a*. Fourth, for purposes later described, an annular recess 164 is formed in a radially inner portion of the upper end of the retainer ring 66**.

The annular upper metal backup shoe 162 is fixedly secured to the cover sleeve 50 for longitudinal translation therewith along the packer body mandrel structure 34. An upper end portion of the shoe 162 underlies the lower end portion 50H of the cover sleeve 50 and is fixedly secured thereto by a threaded joint 166. Other methods could alternatively be used to secure the backup shoe 162 to the cover sleeve 50 if desired. With the well packer in its run-in position illustrated in FIG. 23, a lower end portion of the backup shoe 162 outwardly overlies an upper end portion of the upper end seal member 30A.

When the well packer is hydraulically shifted from its FIG. 23 run-in position to its FIG. 24 set position the shear pins 52 break, permitting the indicated upward shifting of the cover sleeve 50 and the upward shifting of the seal element 30A, and an upper portion of the seal element 30B, onto the prop surface 56 into a radially squeezed condition between the prop surface 56 and the interior side surface of the well casing 14. As illustrated in FIG. 24, with the well packer in its set position the upper backup shoe 162 is upwardly shifted with the cover sleeve, with a lower end portion of the backup shoe 162 being longitudinally deformed by the upper end seal element 30A into a radially bridging relationship with the casing 14. Downward movement of the cover sleeve 50 relative to the body mandrel structure 34 is limited by a circumferentially spaced pair of bolts 168 radially threaded into the body mandrel 34 and having outer end portions slidingly received in a pair of elongated longitudinal slots 170 formed in the cover sleeve 50. Upward movement of cover sleeve 50 relative to the body mandrel structure 34 is limited by an annular ledge 171 (see FIG. 23) that faces the lower cover sleeve end portion 50H.

Upon a subsequent shifting of the well packer from its FIG. 24 position to its FIG. 25 release position the seal members 30A, 30B and 30C are downwardly shifted generally to their original FIG. 23 position on the support surface 48, and the free lower end portion of the upper backup shoe 162 is radially inwardly deformed so as to be able to ride freely along the casing in the space between the lower end of the cover sleeve 50 and the upper end of the seal member 30A. Importantly, because of the connection between the upper backup shoe 162 and the cover sleeve 50, the upper backup shoe 162 is prevented from pulling free and lodging between the seal elements and the casing in a manner jamming the packer in the casing and preventing its withdrawal therefrom.

Referring now to FIGS. 23 and 23A, the modified lower backup shoe structure **64*a* includes an upper annular metal backup shoe member 172 and a lower annular metal backup shoe member 174, each coaxially circumscribing the body mandrel structure 134. With the well packer in its FIG. 23 run-in position, shoe 172 has a vertically extending radially outer portion that outwardly overlies a lower end portion of the lower seal member 30C, and a downwardly and inwardly sloped radially inner portion. Shoe 174 has a vertically extending radially outer portion generally aligned with the radially outer portion of shoe 172, and downwardly and inwardly sloped radially inner portion that is spaced downwardly apart from the sloped radially inner portion of shoe 172 and is received in the previously mentioned annular recess 164 formed in a radially inner portion of the upper end of the retainer ring 66**.

When the well packer is hydraulically shifted from its FIG. 23 run-in position to its FIG. 24 set position, the upper ends of the retainer ring 66 and the retainer collar 68 (which combinatively form a part of an annular force transmitting or abutment means portion of the well packer) longitudinally compress the seal members 30A–30C as shown in FIG. 24 and also deform the bottom backup shoe structure **64*a* into its illustrated radial bridging relationship with the casing 14. This deformation of the bottom backup shoe structure 64*a* forces the radially inner portion of the shoe member 172 downwardly against the radially inner portion of the shoe member 174 and generally into the annular upper end recess 164 of the retainer ring 66**.

A subsequent hydraulic shifting of the well packer from its FIG. 24 set position to its FIG. 25 release position, and movement of the packer upwardly through the casing 14, downwardly deforms radially outer portions of the shoe members 172,174 into the previously described annular pocket area 74 as illustrated in FIGS. 25 and 25A. Due to the provision of the upper end recess 164 in the retaining ring 66, and the receipt of a radially inner portion of the annular bottom backup shoe structure **64*a* therein, the bottom shoe members 172,174 are prevented from being pulled loose from the body mandrel 34** and becoming wedged between the packer and the casing, thereby preventing withdrawal of the well packer from the casing.

As previously mentioned, when provided with the seal assembly 30 the well packer of the present invention is nominally rated at approximately 10,000 psig at about 400° F. The modifications incorporated in the seal assembly 160 advantageously increase this rating to approximately 13,000 psig at about 400°.

A mechanically operable embodiment **10*a* of the retrievable packer 10 is illustrated in FIGS. 26–28 and is provided with a modified seal assembly 160*a* to accommodate its mechanical actuation. The seal assembly 160*a* is shown in FIG. 26 in its run position; in FIG. 27 in its set position; and in FIG. 28** in its release position.

The primary difference between the seal assembly **160*a* and the previously described seal assembly 160 is that in the seal assembly 160*a* the body mandrel structure 34 has a downwardly movable portion in the form of a tubular setting member 34*a* which, with the seal assembly in its FIG. 26 run position, is disposed above the upper seal element 30*a*. The cover sleeve 50 outwardly circumscribes the setting member 34*a* and is attached thereto by the shear pins 52, and the prop surface 56 is formed on the setting member 34***a*.

With the seal assembly 160*a* in its FIG. 26 run position, a tapered lower end portion 176 of the setting member 34*a* is upwardly adjacent the seal member 30*a*. When it is desired to set the retrievable packer 10*a*, the setting member 34*a* is mechanically driven downwardly to its FIG. 27 set position. This causes the setting member end portion 176 to be forced between the seal support surface 48 and an upper end portion of the seal structure to correspondingly force an upper end portion of the seal structure onto the previously described prop surface 56 as described in conjunction with the seal assembly 160 in FIGS. 23–25.

To release the packer 10*a*, and bring it to its FIG. 28 release position, the main body mandrel portion 34 is mechanically lifted to cause an annular, upwardly facing shoulder 178 on the main mandrel portion 34 (see FIG. 27) to engage the inner ends of bolts 180 on the setting member portion 34*a*. The forcible engagement of the shoulder 178 with bolts 180 withdraws the setting member portion 34*a* from beneath the seal structure and causes the seal members 30*a*–30*c* to assume their release positions illustrated in FIG. 28.

Like its hydraulically operable counterpart 10 described in conjunction with FIGS. 23–25, the mechanically operable packer 10*a* utilizes a relative axial movement between the upper and lower shoe structures to force an upper end portion of the seal structure onto the prop surface 56 and thereby squeeze a portion of the seal structure between the prop surface 56 and the casing 14 when the packer is in its set position. As will be appreciated by those skilled in the packer art, the mechanically operable packer 10*a* with its seal assembly 160*a* may be used in gravel packing operations, and has the improved temperature and pressure operating characteristics of the packer 10 with the seal assembly 160.

The foregoing detailed description is to be clearly understood as being given by way of illustration and example only, the spirit and scope of the present invention being limited solely by the appended claims.

What is claimed is:

1. A retrievable well packer coaxially disposable in a well casing having an internal bore side wall, said retrievable well packer comprising:

a tubular body mandrel structure having upper and lower ends, an annular seal element support surface, and an annular seal element prop surface positioned above and radially outwardly offset from said seal element support surface;

a seal element assembly mounted on said seal element support surface for longitudinal movement therealong;

force transmitting means operable to force a portion of said seal element assembly onto said prop surface and radially expand said seal element assembly into set engagement against the internal bore side wall of said well casing;

a cover sleeve mounted on said body mandrel structure for longitudinal movement relative thereto between a downwardly extended position in which said prop surface is covered by said sleeve, and an upwardly retracted position in which said prop surface is uncovered;

frangible means for releasably retaining said cover sleeve in said extended position; and an annular upper shoe structure fixedly secured to said cover sleeve for longitudinal movement therewith relative to said body mandrel structure, said upper shoe structure being engageable by said seal element assembly and deformable thereby into a radial bridging relationship with the internal bore side wall of the well casing when said seal assembly is in set engagement with the internal bore side wall of the well casing.

2. The retrievable well packer of claim 1 wherein:

said seal element assembly has a generally annular configuration, coaxially circumscribes said seal element support surface, and has a radial thickness sized to cause said portion of said seal element assembly forced onto said prop surface to be radially squeezed between said prop surface and the internal bore side wall of the well casing.

3. The retrievable well packer of claim 1 wherein:

said annular upper shoe structure includes an annular upper metal backup shoe member coaxially circumscribing said body mandrel structure and having an upper end portion fixedly secured to a lower end portion of said cover sleeve.

4. The retrievable well packer of claim 3 wherein:

said upper end portion of said upper metal backup shoe member coaxially underlies said lower end portion of said cover sleeve.

5. The retrievable well packer of claim 4 wherein:

said upper end portion of said upper metal backup shoe member is threadingly connected to said lower end portion of said cover sleeve.

6. The retrievable well packer of claim 1 further comprising:

movement limiting means for limiting the longitudinal movement of said cover sleeve relative to said body mandrel structure subsequent to a breakage of said frangible means permitting such longitudinal movement.

7. The retrievable well packer of claim 6 wherein said movement limiting means include:

a longitudinally extending side wall slot formed in said cover sleeve, and a stop member secured to said body mandrel structure and received in said slot.

8. The retrievable well packer of claim 7 wherein:

said stop member is a bolt threaded into said body mandrel structure and having an outer end portion received in said slot.

9. The retrievable well packer of claim 1 wherein:

said retrievable well packer is a hydraulically operable well packer, said force transmitting means are forcibly engageable with said seal element assembly to upwardly move said seal element assembly along said seal element support surface, and said upper shoe structure is engageable by said seal element assembly during upward movement thereof by said force transmitting means.

10. The retrievable well packer of claim 1 wherein:

said retrievable well packer is mechanically operable, said body mandrel structure includes a tubular setting member portion upon which said prop surface is disposed, said setting member portion having a lower end portion, and said force transmitting means are operable to downwardly drive said lower setting member end portion between said seal element support surface and said seal element assembly to force said portion of said seal element assembly onto said prop surface.

11. A retrievable well packer coaxially disposable in a well casing having an internal bore side wall, said well packer comprising:

a tubular body mandrel having upper and lower ends and an annular seal element support surface;

an annular seal element assembly coaxially and externally mounted on said seal element support surface and having a lower end;

an annular lower shoe structure coaxially circumscribing said body mandrel downwardly adjacent said seal element assembly and having an annular, radially inner edge portion; and an annular abutment structure mounted on said body mandrel below said lower shoe structure and having an upper end with an annular recess formed in a radially inner portion thereof, said annular abutment structure, in response to axial compression of said annular seal element assembly thereagainst, being operative to cause said radially inner edge portion of said lower shoe structure to enter said annular recess of said annular abutment structure, radially expand said seal element assembly into set engagement with the internal bore side wall of the well casing, and deform said lower shoe structure into a radially bridging relationship with the internal bore side wall of the well casing.

12. The retrievable well packer of claim 11 wherein said annular lower shoe structure includes:

a first annular metal backup shoe member having a downwardly and inwardly sloped radially inner annular portion circumscribing said seal element support surface between said seal element assembly and said annular abutment structure, and a generally upwardly extending annular radially outer portion outwardly overlying a lower end portion of said seal element assembly, and a second annular metal backup shoe member having a downwardly and inwardly sloped radially inner annular portion circumscribing said seal element support surface between said annular abutment structure and said radially inner portion of said first shoe member, and an upwardly extending radially outer portion generally radially aligned with said radially outer portion of said first shoe member, said radially inner annular portion of said second backup shoe member being spaced downwardly apart from said radially inner annular portion of said first backup shoe member and being received in said annular recess in said annular abutment structure.

13. The retrievable well packer of claim 11 wherein said annular abutment structure is operable to create on an upper end portion thereof a radially outer annular pocket area into which a radially outer annular portion of said lower shoe structure may be downwardly deformed during withdrawal of said well packer from the casing.

14. A retrievable well packer coaxially disposable in a well casing having an internal bore side wall, said well packer comprising:

a tubular body mandrel structure having upper and lower ends, an annular seal element support surface, and an annular seal element prop surface positioned above and radially outwardly offset from said seal element support surface;

an annular seal element assembly coaxially mounted externally on said seal element support surface for longitudinal movement therealong, and having upper and lower ends;

a cover sleeve coaxially and externally mounted on said body mandrel structure for longitudinal movement relative thereto between a downwardly extended position in which said prop surface is covered by said sleeve, and an upwardly retracted position in which said sleeve uncovers said prop surface, said cover sleeve having a lower end facing said upper end of said seal element assembly;

frangible means for releasably retaining said cover sleeve in said extended position thereof;

an annular upper shoe structure coaxially circumscribing said body mandrel structure and fixedly secured to said lower end of said cover sleeve for longitudinal movement with said cover sleeve relative to said body mandrel structure;

an annular lower shoe structure coaxially circumscribing said body mandrel structure downwardly adjacent said seal element assembly, said lower shoe structure having an annular radially inner edge portion;

an annular abutment structure coaxially mounted on said body mandrel structure below said lower shoe structure and having an upper end with an annular recess formed in a radially inner portion thereof, said annular abutment structure, in response to driven movement of one of said upper and lower shoe structures toward the other of said upper and lower shoe structures, being operative to cause (1) said seal element assembly to be longitudinally compressed between said upper and lower shoe structures, (2) said seal element assembly to longitudinally drive said cover sleeve from said extended position thereof to said retracted position thereof, (3) an upper end portion of said seal element assembly to be driven onto said prop surface, (4) said seal element assembly to be radially expanded into set engagement with the internal bore side wall of the well casing, (5) said upper and lower shoe structures to be deformed into radially bridging engagements with the internal bore side wall of the well casing, and (6) said annular edge portion of said lower shoe structure to enter and be radially retained within said annular recess in said upper end of said abutment structure; and force transmitting means operable to drive one of said upper and lower shoe structures toward the other of said upper and lower shoe structures.

15. The retrievable well packer of claim 14 wherein:

said seal element assembly has a generally annular configuration, coaxially circumscribes said seal element support surface, and has a radial thickness sized to cause said portion of said seal element assembly forced onto said prop surface to be radially squeezed between said prop surface and the internal bore side wall of the well casing.

16. The retrievable well packer of claim 14 wherein:

said annular upper shoe structure includes an annular upper metal backup shoe member coaxially circumscribing said body mandrel structure and having an upper end portion fixedly secured to a lower end portion of said cover sleeve.

17. The retrievable well packer of claim 16 wherein:

said upper end portion of said upper metal backup shoe member coaxially underlies said lower end portion of said cover sleeve.

18. The retrievable well packer of claim 16 wherein:

said upper end portion of said upper metal backup shoe member is threadingly connected to said lower end portion of said cover sleeve.

19. The retrievable well packer of claim 14 further comprising:

movement limiting means for limiting the longitudinal movement of said cover sleeve relative to said body mandrel structure subsequent to a breakage of said frangible means permitting such longitudinal movement.

20. The retrievable well packer of claim 19 wherein said movement limiting means include:

a longitudinally extending side wall slot formed in said cover sleeve, and a stop member secured to said body mandrel structure and received in said slot.

21. The retrievable well packer of claim 20 wherein:

said stop member is a bolt threaded into said body mandrel structure and having an outer end portion received in said slot.

22. The retrievable well packer of claim 14 wherein said annular lower shoe structure includes:

a first annular metal backup shoe member having a downwardly and inwardly sloped radially inner annular portion circumscribing said seal element support surface between said seal element assembly and said annular abutment structure, and a generally upwardly extending annular radially outer portion outwardly overlying a lower end portion of said seal element assembly, and a second annular metal backup shoe member having a downwardly and inwardly sloped radially inner annular portion circumscribing said seal element support surface between said annular abutment structure and said radially inner portion of said first shoe member, and an upwardly extending radially outer portion generally radially aligned with said radially outer portion of said first shoe member, said radially inner annular portion of said second backup shoe member being spaced downwardly apart from said radially inner annular portion of said first backup shoe member and being received in said annular recess in said annular abutment structure.

23. The retrievable well packer of claim 14 wherein said annular abutment structure is operable to create on an upper end portion thereof a radially outer annular pocket area into which a radially outer annular portion of said lower shoe structure may be downwardly deformed during withdrawal of said well packer from the casing.

24. The retrievable well packer of claim 14 wherein:

said force transmitting means are hydraulically operable.

25. The retrievable well packer of claim 14 wherein:

said force transmitting means are mechanically operable.

* * * * *